US005448841A

United States Patent [19]

Hampton

[11] Patent Number: 5,448,841

[45] Date of Patent: Sep. 12, 1995

[54] PICTURE OR POSTER FRAME

[76] Inventor: Robin F. T. Hampton, 18 Bidwell Place, Christchurch, New Zealand

[21] Appl. No.: 102,485

[22] Filed: Aug. 5, 1993

[30] Foreign Application Priority Data

Aug. 5, 1992 [NZ] New Zealand ..... 243849

[51] Int. Cl.[6] ..... G09F 1/12

[52] U.S. Cl. ..... 40/155; 40/152

[58] Field of Search ..... 40/152, 152.1, 155, 40/605

[56] References Cited

U.S. PATENT DOCUMENTS

| | | | |
|---|---|---|---|
| 958,082 | 5/1910 | Bland | 40/155 |
| 1,319,513 | 10/1919 | Colegrove | 40/155 X |
| 1,335,854 | 4/1920 | O'Callahan | 40/155 X |
| 1,346,691 | 7/1920 | Babcock | 40/155 |
| 2,136,906 | 11/1938 | McAdams | 40/155 X |
| 3,783,543 | 1/1974 | Hemgren | 40/152 |
| 4,059,914 | 11/1977 | Dobson | 40/605 X |
| 4,399,625 | 8/1983 | Langan | 40/155 |

*Primary Examiner*—Brian K. Green
*Attorney, Agent, or Firm*—Jones & Askew

[57] ABSTRACT

An adjustable poster frame having a series of corner members and telescoping members. Each corner member being adapted to interlock with telescoping members which telescope relative to each other and interfit with the corner members. The telescoping members being constructed so that they have at least one outer telescoping member and an inner telescoping member such that they frictionally engage with each other to form a frame and border for a poster or picture, the outer telescoping member engaging the corner members. Two adjustable poster frames may be joined back to back by means of at least two connecting pegs.

2 Claims, 3 Drawing Sheets

PICTURE OR POSTER FRAME

FIELD OF INVENTION

This invention relates to a frame for a poster, picture or the like and more particularly relates to a frame the size of which can be adjusted to suit the size of poster, picture or the like to be supported thereby.

BACKGROUND OF THE INVENTION

The applicant is the proprietor of New Zealand Patent Specification No. 224613 which describes and claims a method of mounting a picture or poster. A disadvantage of this method is the need to utilize securing pin means to both hold the frame together and the picture or poster to the frame.

An object of the invention is to overcome the above-identified disadvantage and provide an adjustable frame the overall size of which can be adjusted to suit the size of a poster or the like to be supported in or by the frame.

Further objects and advantages of the invention will become apparent from the following description which is given by way of example only.

SUMMARY OF THE INVENTION

According to one aspect of the present invention there is provided an adjustable poster frame, the poster frame having regular shape in front elevation, the frame having a series of corner members, each corner member being adapted to interlock with telescoping members which telescope relative to each other and interfit with the corner members, the telescoping members being constructed so that they have at least one outer telescoping member and an inner telescoping member such that they frictionally engage with each other to form a frame and border for a poster or picture, the outer telescoping member engaging the corner members.

The corner members can each have spigots the external shape of which is complementary to the internal shape of the outer part of the adjacent telescoping members.

The corner members can each have shaped recesses the internal shape of which is complementary to the external shape of the outer part of the adjacent telescoping member.

One of the telescoping members can be compressible in section by providing a longitudinal slot along one face so that the inherent flexibility of the member allows for a frictional fit with the other telescoping member.

According to a second aspect of the invention there is provided an adjustable poster frame and poster assembly according to the first aspect and in which the edges of a poster or picture are attached to one surface of the frame to form a frame and border for the poster or picture.

The corner members and telescoping members can be formed from a plastic material and may be coated by an aesthetically attractive surface coating.

The frame can be square, triangular or the like in elevation.

The telescoping members can be extruded from a plastic material or aluminium and the corner members may be cast or injection moulded from a similar material.

Two frames can be connected back-to-back by means of a connecting peg, the connecting peg being a complimentary fit to the back of a corner member of one frame and a complimentary fit to the back of the corner member of the second frame.

The connecting peg may have spigots which frictionally engage part of the back side of a corner member.

According to a further aspect of the invention there is provided a method of mounting a poster or picture, the method including the steps of:

connecting the corner members to the outer telescoping members;

frictionally engaging the inner telescoping members to the outer telescoping members to form a generally regular frame;

adjusting the size of the frame, by telescoping the telescoping members, to suit a poster or picture;

placing the poster or picture on the frame with the edges of the poster or picture on the frame;

attaching the poster or picture to the outer telescoping member.

The method may also include the step of adjusting the telescoping members after the picture or poster has been attached to give a flat appearance to the poster or frame.

The method may also allow for two posters or picture frames made by the method described to be joined back to back to one another by the method described by including the step of using at least two connecting pegs fitted to adjacent corner members of both frames.

Further aspects of the invention which should be considered in all its novel aspects will become apparent from the following description which is given by way of example only.

An example of the invention will now be described with reference to accompanying drawings in which:

DESCRIPTION OF THE PREFERRED EMBODIMENTS

Figure 2:
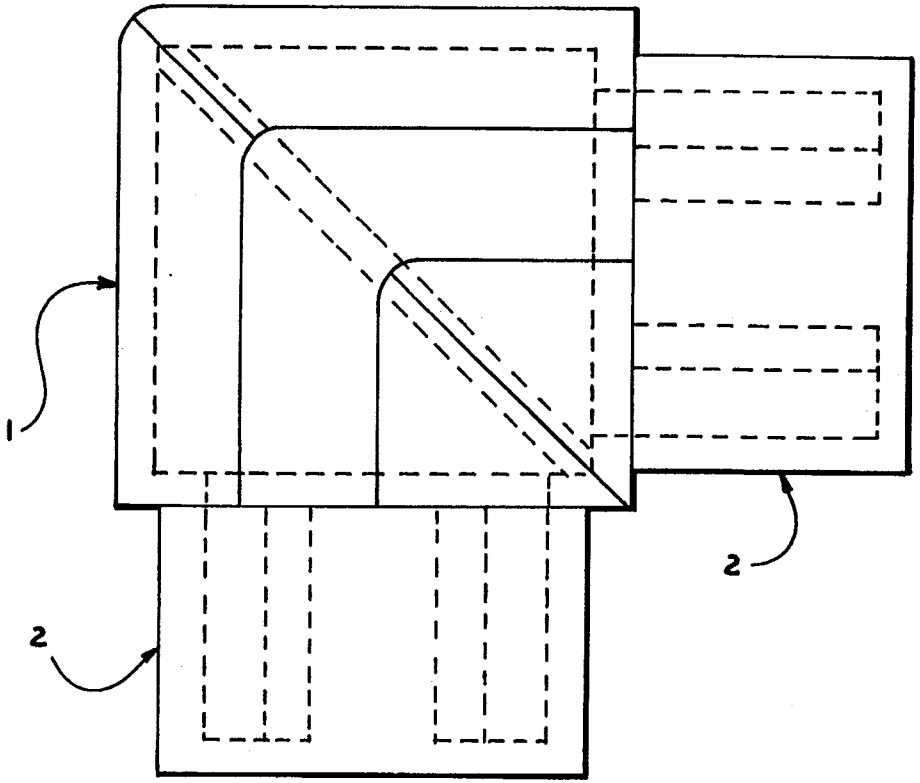
FIG. 2 shows a plan view of a corner member for the frame shown in FIG. 1 wherein the parts thereof are exploded apart.
Figure 1:
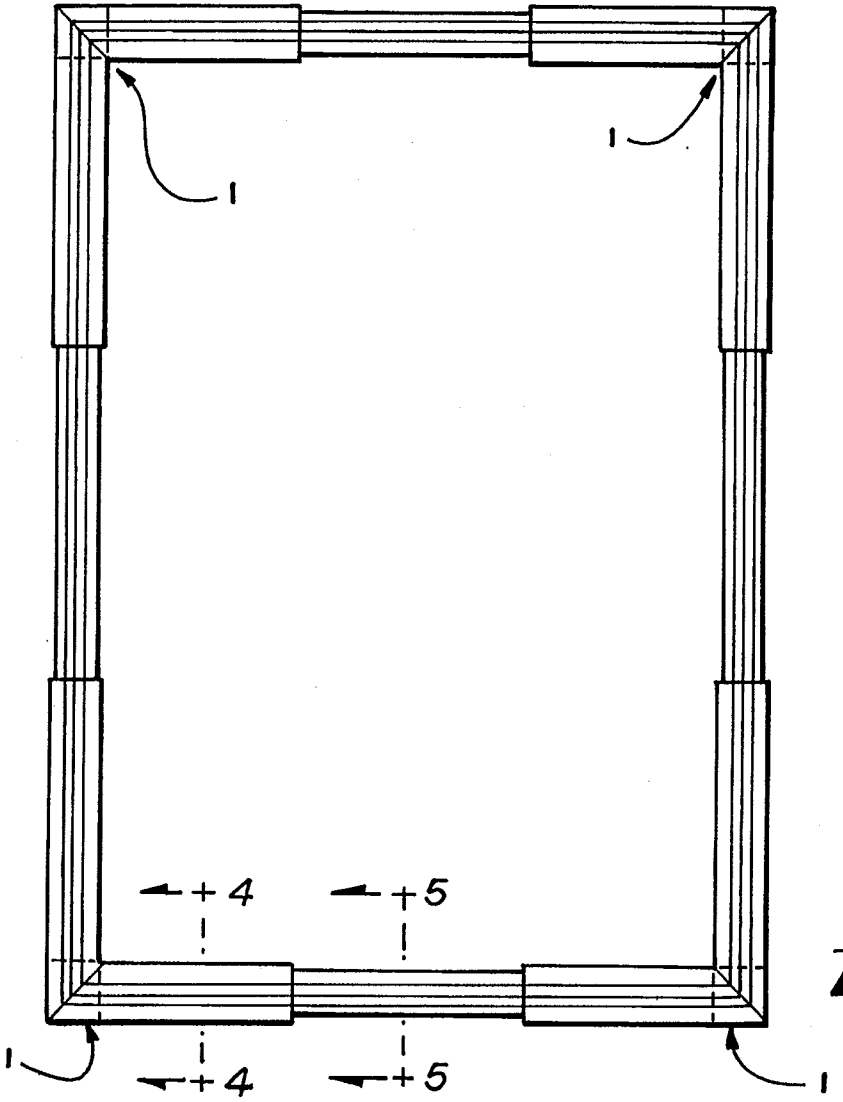
FIG. 1 shows a front elevation of an example of poster frame according to the invention.
Figure 3:
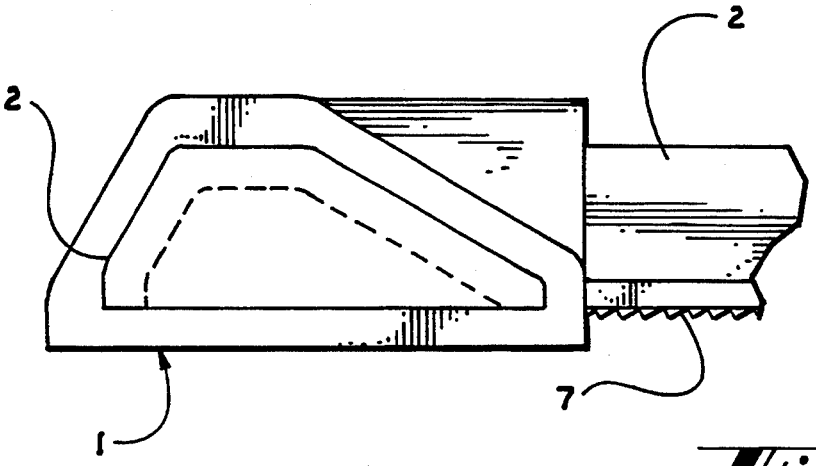
FIG. 3 shows a side elevation of the corner member shown in FIG. 2.

The adjustable frame shown in FIG. 1 has four corner members all of the same general shape. In the example the frame is rectangular and there are four corner members each of which is indicated by the arrow 1. Each corner member 1 has two spigots 2 extending therefrom. The spigots 2 are formed during manufacturing of the corner member 1 in an injection moulding machine. If other than a rectangular shape of frame is required the angle between the longitudinal axes of the spigots 2 can be different, for example a 60° degree angle is suitable for a triangular frame or a 135° degree angle is suitable for an octagonal frame.

Figure 4:
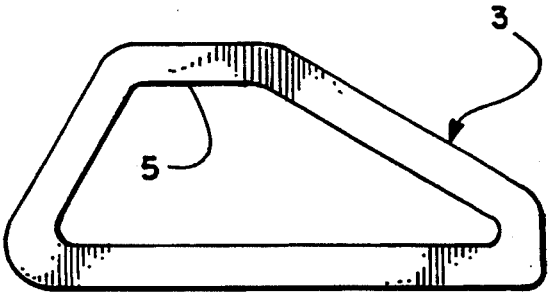
FIG. 4 shows a section taken along line 4—4 of FIG. 1 through an outer telescoping member of the poster frame shown in FIG. 1.
Figure 5:
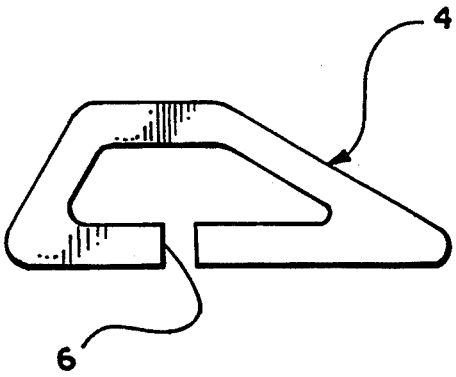
FIG. 5 shows a section taken along line 5—5-of FIG. 1 through an inner telescoping member of the poster frame in FIG. 1.

The corner members 1 are linked by a series of telescoping link members 3 and 4 shown in section in FIGS. 4 and 5.

In FIG. 4 is shown an outer member 3. The member 3 in cross-section has a similar shape to the spigot 2 extending from the corner members 1. The telescoping member may be extruded from a plastic or metal material.

In FIG. 5 is shown a cross-section through an inner member 4. The inner member 4 is compressible so that it can slidingly engage within a similarly shaped aperture 5 in the outer member 3. In the example shown the member 4 is compressible by providing a longitudinal slot or gap 6 in one wall of the member 4. The slot 6 allows the cross-sectional area of the member 4 to be reduced so that it can be slidingly engaged with the outer member 3.

The face 7 of the spigots 2 can be tapered to create a frictional fit with the member 3 fitted thereon. Alternatively the surface 7 may be textured or roughened to create the same frictional fit.

Figure 6:
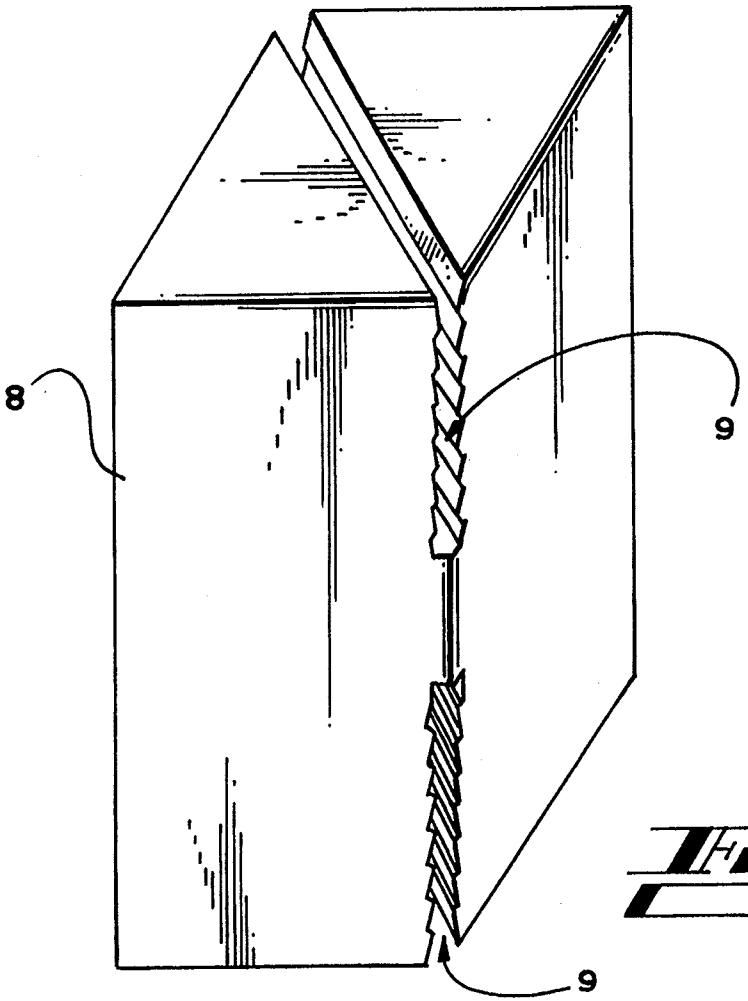
FIG. 6 shows a plan view of a slotted connecting peg.

FIG. 6 shows a connecting peg 8 with slots 9. The fram may be connected to a second frame, the back of the frame to the back of the second frame by the connecting peg 8. The connecting peg 8 being a complementary fit to the back of a corner member of the frame and a complementary fit to the back of the corner member of the second frame. The slot 9 in the connecting peg 8 creates a frictional fit with the corner members.

Figure 7:
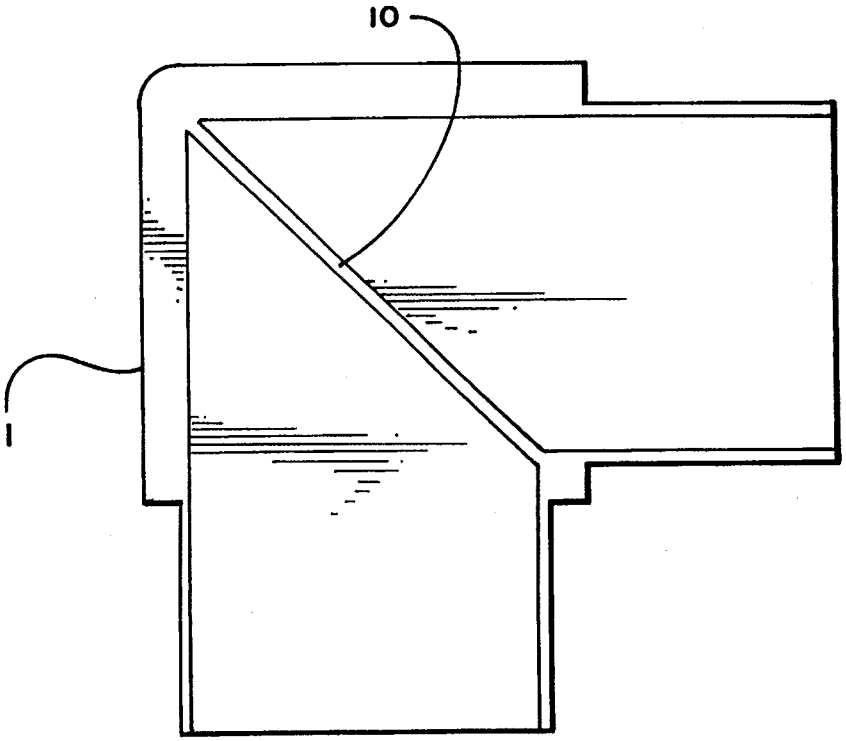
FIG. 7 shows a back view of a corner member.

FIG. 7 shows the back of a corner member with a ridge part 10. The ridge part 10 frictionally fits the slot 9 on a connecting peg.

In use the frame is used with a poster, picture or the like, by using a securing means to hold the poster to one surface of the frame. The securing means can be lengths of adhesive tape, magnetic tape or the like which locate the poster and frame together.

The exposed surface coating having an aesthetically pleasing appearance. For example the corner members and link members can be coated with a powder coating or electroplated to have a desired appearance.

The members can be painted or coated with appropriate colors for aesthetics and can be constructed from round, square, oval or rectangular sectioned plastic tube.

Thus by this invention there is provided an adjustable frame the overall size of which can be adjusted to suit the size of the poster or the like to be supported in or by the frame.

Particular examples of the invention have been described by way of examples and it is envisioned that improvements and modifications can take place without departing from the scope thereof.

What I claim is:

1. An adjustable poster frame assembly comprising a pair of adjustable poster frames in which:

each poster frame has a regular shape in a front elevation;

each frame having a series of corner members and a plurality of sides interlocking with adjacent corner members;

each side comprising at least two outer telescoping members engaging adjacent corner members and at least one inner telescoping member telescoping relative to the outer telescoping members; and at least some of the telescoping members of each side being sufficiently flexible so as to frictionally engage with each other and maintain a selected telescoping length of the side, so that the sides of each poster frame form a frame and a border for a poster or like object surrounded by the corner members and the sides;

and a series of connecting pegs each of which is a complementary fit to a back of a corner member of one frame and a complementary fit to the corner member of the other frame;

each connecting peg having slots which frictionally engage part of a back side of a complementary corner member so that the two similar adjustable poster frames can be connected back-to-back by means of the connecting pegs.

2. An adjustable poster frame assembly as in claim 1 wherein the corner members each have spigots, the spigots having an external shape which is complementary to an internal shape of adjacent outer telescoping members.

* * * * *